US009413063B1

(12) United States Patent
Apostolos et al.

(10) Patent No.: US 9,413,063 B1
(45) Date of Patent: Aug. 9, 2016

(54) ANTENNA-COUPLED METAL-INSULATOR-METAL RECTIFIER

(71) Applicant: AMI Research & Development, LLC, Windham, NH (US)

(72) Inventors: John T. Apostolos, Lyndeborough, NH (US); William Mouyos, Windham, NH (US); Patricia Bodan, Amherst, MA (US); Milton Feng, Champaign, IL (US); Benjamin McMahon, Nottingham, NH (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 0 days.

(21) Appl. No.: 14/740,588

(22) Filed: Jun. 16, 2015

Related U.S. Application Data

(60) Provisional application No. 62/013,175, filed on Jun. 17, 2014.

(51) Int. Cl.

| | |
|---|---|
| ***H01B 13/00*** | (2006.01) |
| ***H01L 29/06*** | (2006.01) |
| ***H01Q 1/36*** | (2006.01) |
| ***H01Q 9/28*** | (2006.01) |
| ***C23C 8/36*** | (2006.01) |
| ***C23C 8/80*** | (2006.01) |

(52) U.S. Cl.
CPC *H01Q 1/364* (2013.01); *C23C 8/36* (2013.01); *C23C 8/80* (2013.01); *H01Q 9/285* (2013.01)

(58) Field of Classification Search
None
See application file for complete search history.

(56) References Cited

U.S. PATENT DOCUMENTS

| | | | | |
|---|---|---|---|---|
| 5,236,573 | A | 8/1993 | Shannon | |
| 8,115,683 | B1 | 2/2012 | Stefanakos et al. | |
| 8,222,077 | B2 | 7/2012 | Gong et al. | |
| 2004/0232406 | A1* | 11/2004 | Weiss | H02S 99/00 257/35 |
| 2007/0240757 | A1 | 10/2007 | Ren et al. | |
| 2010/0244656 | A1* | 9/2010 | Ito | H01Q 1/2283 313/358 |
| 2015/0104921 | A1* | 4/2015 | Terai | H01L 45/16 438/382 |

FOREIGN PATENT DOCUMENTS

EP 2 587 587 A1 5/2013

OTHER PUBLICATIONS

Jeffrey A. Bean, et. al, "Performance Optimization of Antenna-Coupled Al/AlOx/Pt Tunnel Diode Infrared Detectors," *IEEE J. of Quantum Electronics*, vol. 47, No. 1, Jan. 2011.

Philip C.D. Hobbs, et. al., "Ni—NiO—Ni tunnel junctions for terahertz and infrared detection," Applied Optics, vol. 44, No. 32, Nov. 10, 2005.

* cited by examiner

*Primary Examiner* — Shamim Ahmed
(74) *Attorney, Agent, or Firm* — McGarry Bair PC

(57) ABSTRACT

The use of rectennas, or antenna-coupled rectifiers, using metal-insulator-metal tunnel diodes as rectifiers for energy conversion has been explored with more fervor recently, given the advances in nanotechnology fabrication and increased resolution of features. Some have made these devices from symmetric metals (e.g. Ni—NiO—Ni) and asymmetric metals (e.g. Al—AlOx/Pt), and have used deposited oxides as well as native oxides. One key to obtaining a highly asymmetric device with efficient current generation needed for high conversion efficiency is to instead use dissimilar metals and a thin reproducible oxide. The described method allows for a thin, reproducible native oxide of nickel be integrated with any antenna metal to overcome oxide surface roughness problems that typically hamper the practicality of these devices.

6 Claims, 4 Drawing Sheets

ANTENNA-COUPLED METAL-INSULATOR-METAL RECTIFIER

CROSS-REFERENCE TO RELATED APPLICATIONS

The present application claims the benefit of U.S. Provisional Patent Application Ser. No. 62/013,175, which was filed on Jun. 17, 2014, by John T. Apostolos et al. for a ANTENNA-COUPLED METAL-INSULATOR-METAL RECTIFIER and is hereby incorporated by reference.

TECHNICAL FIELD

This patent application relates to the fabrication of antenna-coupled metal-insulator-metal (MIM) rectennas and, specifically to formation of a native oxide insulating layer, providing an ability to be fabricated with various metals.

BACKGROUND

There are a variety of applications for rectennas and tunnel diodes, including energy harvesting, rectification, and harmonic mixers for down and up conversion. Dipole, bowtie and spiral antenna shapes are some of the geometries of interest. A planar, thin film MIM diode is typically formed in a small overlap region between two (2) "arms" of an antenna. Several such devices have been developed for Radio Frequency (RF) and infrared (IR) frequency ranges. The asymmetry of the work functions of the different metals results in devices having asymmetric current flow, which allows them to be used as rectifiers and similar applications.

See the following for further background information:

Jeffrey A. Bean, et. al, "Performance Optimization of Antenna-Coupled Al/AlOx/Pt Tunnel Diode Infrared Detectors," *IEEE J. of Quantum Electronics*, Vol 47, No. 1, January 2011.

Philip C. D. Hobbs, et. al., "Ni—NiO—Ni tunnel junctions for terahertz and infrared detection," *Applied Optics*, Vol. 44, No. 32, Nov. 10, 2005.

U.S. Pat. No. 8,115,683 B1, "Rectenna Solar Energy Harvester."

SUMMARY OF THE INVENTION

As the desired operating frequency range increases to the tens or even hundreds of terahertz, device sizes become submicron. At such small dimensions, metal properties become less conductive, making these miniscule devices very difficult to fabricate and also less efficient. Higher frequency operation also requires very small geometries in order to provide a small enough Resistor-Capacitor (RC) time constant.

Several attempts at achieving the required asymmetry and small size have resorted to using geometric point-like diodes to favor directional current flow. But these devices are essentially planar whisker diodes that often do not have a reliable fabrication process to produce repeatable metal-insulator interfaces that consistently provide the same geometry and surface contact features when an array of similar devices is required.

In particular embodiments, the metal deposition of many MIM devices utilize a shadow mask double angle electron beam (e-beam) write process, where an oxide is typically formed by either Atomic Layer Deposition (ALD) or by forming a native oxide of the bottom metal. The latter native oxidation process has been found to produce a more reliable and controllable oxide that has good surface roughness (e.g. <0.2 nm RMS) and thin enough for field emission (Fowler-Nordheim) tunneling.

Different metals oxidize at different rates. Aluminum for example, oxidizes very well, but rapidly. This constrains the design of a MIM rectifier to certain metals, as it is thought that chosen oxidation process must be tailored to the metal.

However, preferred herein is a specific native nickel oxide process for MIM devices that can be used with many different metals, to provide a consistent, reliable oxidation layer to optimize field emission tunneling. The approach also provides design flexibility to achieve high efficiency performance.

In one implementation, a thin layer (5-20 nm) of nickel is added on top of a bottom layer metal to form a native oxide after Reactive Ion Etching (RIE).

The slow native oxidation rate allows for a more controlled, yet flexible process, where the entire thin Ni layer is oxidized after oxygen Reactive Ion Etching (RIE).

Several devices have been fabricated using a bowtie antenna and metals consisting of nickel (Ni), platinum (Pt) and gold (Au) at a design wavelength of 10.6 μm. However, devices can be fabricated for other wavelengths including millimeter wave, infrared, near infraread, and visible using the same techniques.

The elements may be individually formed as bowties or other shapes and/or fabricated in regularly spaced arrays on a common substrate.

DETAILED DESCRIPTION OF AN EXAMPLE EMBODIMENT

One embodiment of a process specific for fabricating an Al—NiOx-Pt "bowtie" MIM rectenna is illustrated in FIGS. 1-6. These steps are a specific example of fabricating a bowtie MIM rectenna using an arbitrary set of bottom and top metal layers while still using a NiOx insulator. This arrangement is favorable because its slow native oxidation rate allows for a more controlled process. In general, a thin Ni layer (of between 5-20 nm in thickness) is deposited over a bottom metal layer to form a first radiating element of a bowtie antenna. The entire thin Ni layer can then be oxidized using RIE such that a metal-NiOx bottom layer is obtained. Note that partial oxidation of the Ni layer results in a metal-Ni—NiOx bottom layer. Afterwards, an arbitrary top metal layer may be deposited without any additional complexity. The top metal layer forms a second radiating element of the bowtie. A contact pad deposition step or other fabrication steps may then follow.

Process Steps for Al—NiO—Pt MIM Diode

Figure 6:
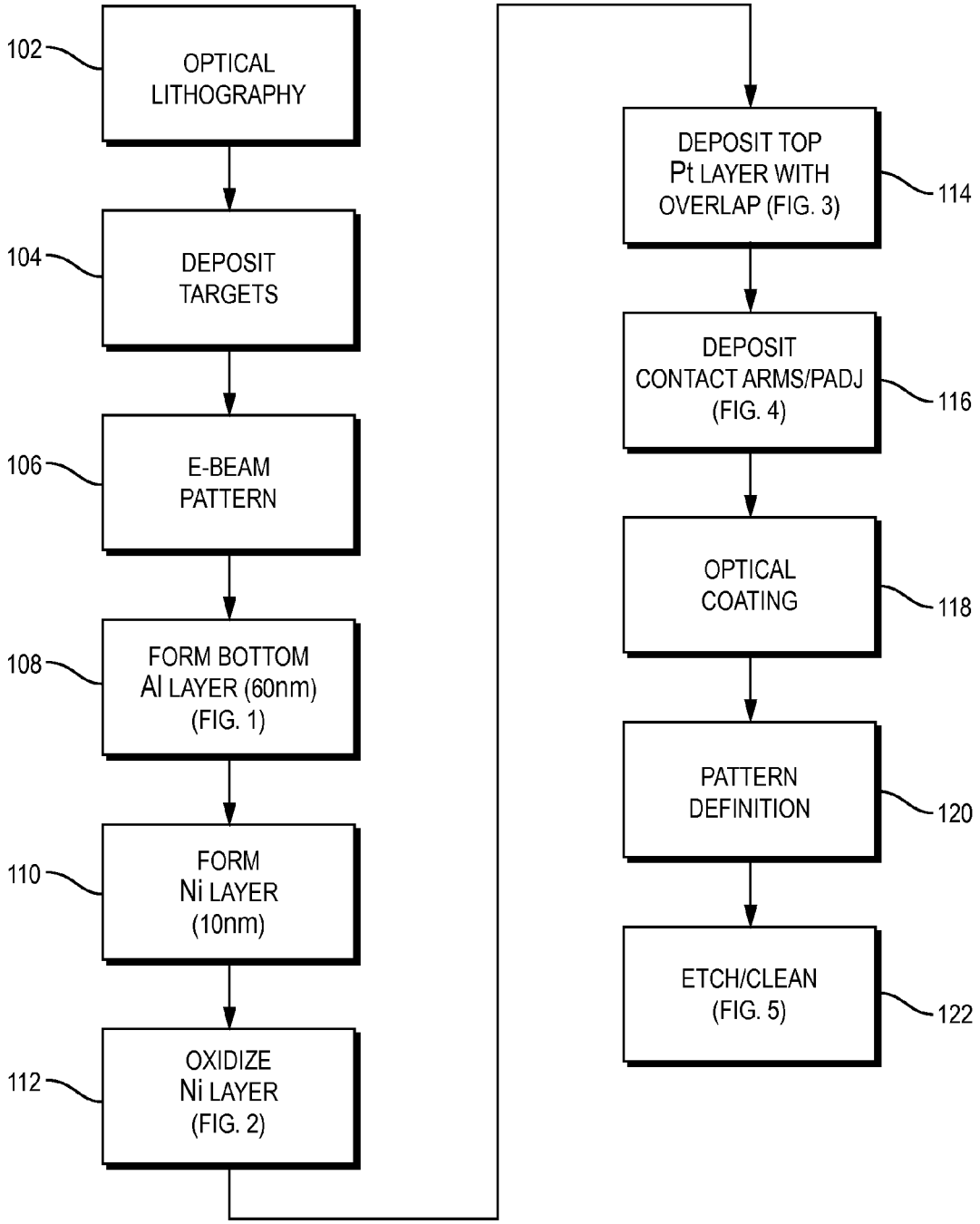
FIG. 6 is a process flow diagram for fabricating the bowtie MIM rectenna.

A high level flow diagram of process steps for fabricating the MIM rectenna is provided in FIG. 6. This figure can be referred to with the more detailed text explanation that follows. Please note certain steps, such as cleaning steps, are not shown in the high level diagram of FIG. 6 but are described below.

1. Targets Deposition

Alignment targets for subsequent e-beam and optical lithography steps are deposited on a Si wafer with $SiO_2$ buffer layer in step 104, after initial optical lithography patterning in step 102.

2. Bottom Aluminum (Al) Deposition with Nickel (N) Top Layer

Figure 1A:
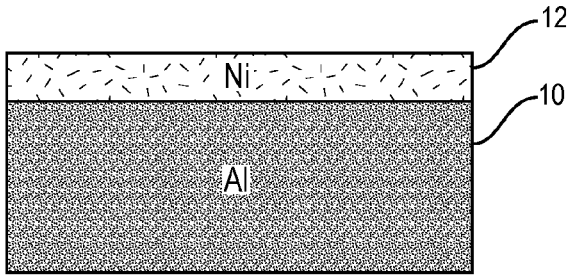
FIGS. 1A and 1B are side and top views, respectfully, of a bottom metal layer with thin Ni layer towards an initial step in forming a bowtie MIM rectenna.
Figure 1B:
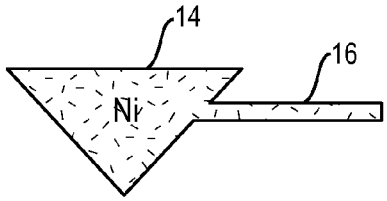

A 60 nm bottom Al layer is deposited (step 108) after e-beam patterning (step 106). FIGS. 1A and 1B are side and top views of the result. Note that an $Si/SiO_2$ substrate is not shown in the side view of FIG. 1A. In FIG. 1A, reference numeral 10 indicates the Al layer and 12 indicates the Ni layer. FIG. 1B shows the first bowtie element 14 (shaped as a triangle in this example) and associated arm 16.

Process (Steps 106, 108 and 110):

2.1. Wafer solvent clean (Acetone, Methanol, IPA)+$N_2$ dry+dehydration bake 2.2. Double-layer e-beam photoresist (PR) spin coating (double-layer process for easy liftoff)

a. PMMA EL13 b. PMMA A2 950K 2.3. Pattern Definition (e-beam write and O2 descum)

a. E-beam writing using JEOL e-beam b. Develop in 1:3 MIBK:IPA with IPA rinse and $N_2$ dry c. $O_2$ plasma descum using TI Planar RIE (to remove PR residues)

2.4. Evaporate Al 60 nm 2.5 Evaporate Ni 10 nm 2.6. Bottom Al/Ni Liftoff a. Methylene Chloride soak until liftoff b. 1:1 Methylene Chloride:Methanol soak c. Methanol rinse and IPA rinse and N2 dry 3. Bottom Ni Oxidation (Step 112)

Figure 2:
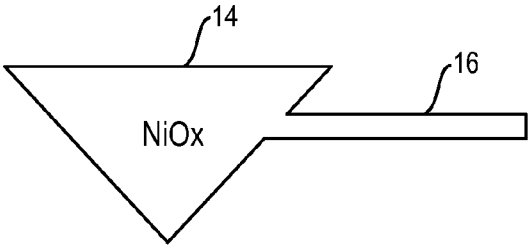
FIG. 2 is a top view after RIE oxidation.
Figure 3:
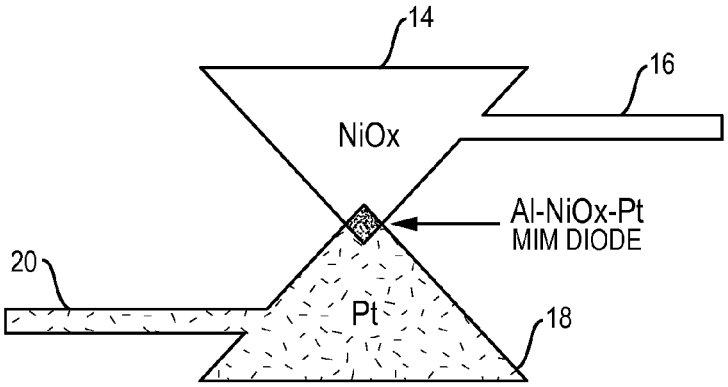
FIG. 3 illustrates the MIM diode formed in an overlap region after deposition of a top metal layer.

The Ni layer is then oxidized using Slave RIE to form a NiOx layer that acts as the insulator in the MIM diode. FIG. 2 illustrates the result. $O_2$ plasma oxidation using RIE was found to yield the best results compared to atomic layer deposition and dionized water oxidation.

4. Top Pt Deposition+MIM Diode Formation (Step 114)

A 60 nm top Platinum (Pt) layer is then deposited over the oxidized bottom layer after e-beam patterning (see step 2 for detailed process), with a controlled overlap region. The overlap forms a Al-NiOx-Pt MIM structure (See FIG. 3). Care should be taken in selecting developers that will not etch away the NiOx.

After this step, the second bowtie element 18 and associated CRM 20 are formed.

5. Contact Pad Deposition (Step 116)

Next, 0.02 μm/0.15 μm Ti/Au contact pads (22, 24) may be deposited over the contact arms for measurement purposes. Before deposition, a Hydrogen Chloride (HCl) etch is performed to remove NiOx from the MIM contact arms in order to provide good contact with the Ti/Au contact pads.

6. Process:

6.1. Wafer solvent clean (Acetone, Methanol, IPA)+$N_2$ dry+dehydration bake 6.2. Double-layer optical PR Coating (Step 118)

a. PMGI SF11 b. BPRS-100

6.3. Pattern Definition (Step 120)

a. Contact exposure and+develop in 1:4 PLSI:$H_2O$ b. Deep UV Exposure and develop in 101A c. Deep UV Exposure and develop in 101A (repeated to form undercut for easy liftoff)

d. $O_2$ plasma descum using RIE (to remove PR residues)

6.4. 40% HCl etch (to remove NiOx from contact arms) (Step 122)

Figure 4:
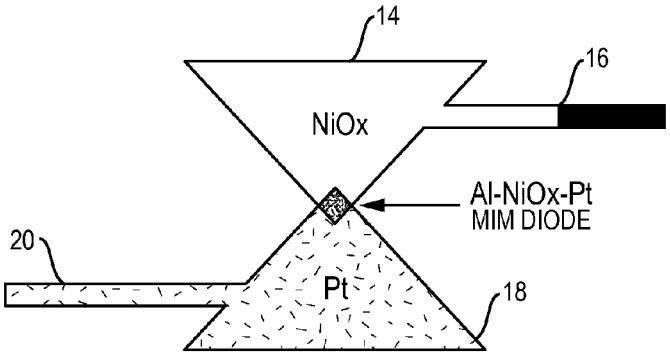
FIG. 4 shows the bowtie MIM rectenna after removal of excess NiOx.
Figure 5:
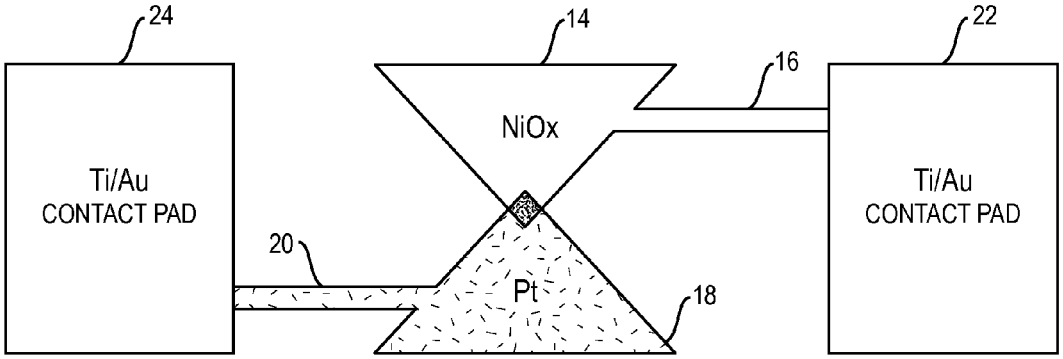
FIG. 5 shows the final bowtie MIM rectenna fabrication with contact pads.

FIG. 4 shows the result at this stage, after excess NiOx is removed from the bottom contact arm 16. This step is expose the bottom contact arm 16 to a contact pad.

6.5. Evaporate Ti/Au 20 nm/150 nm 6.6. Contact Pad Liftoff a. Acetone soak until liftoff and Methanol Rinse b. 1165 Microposit Remover soak and Methanol Rinse c. Methanol rinse and IPA rinse and N2 dry FIG. 5 sows the final bowtie MIM rectenna with contact pads (22, 24).

Figure 7:
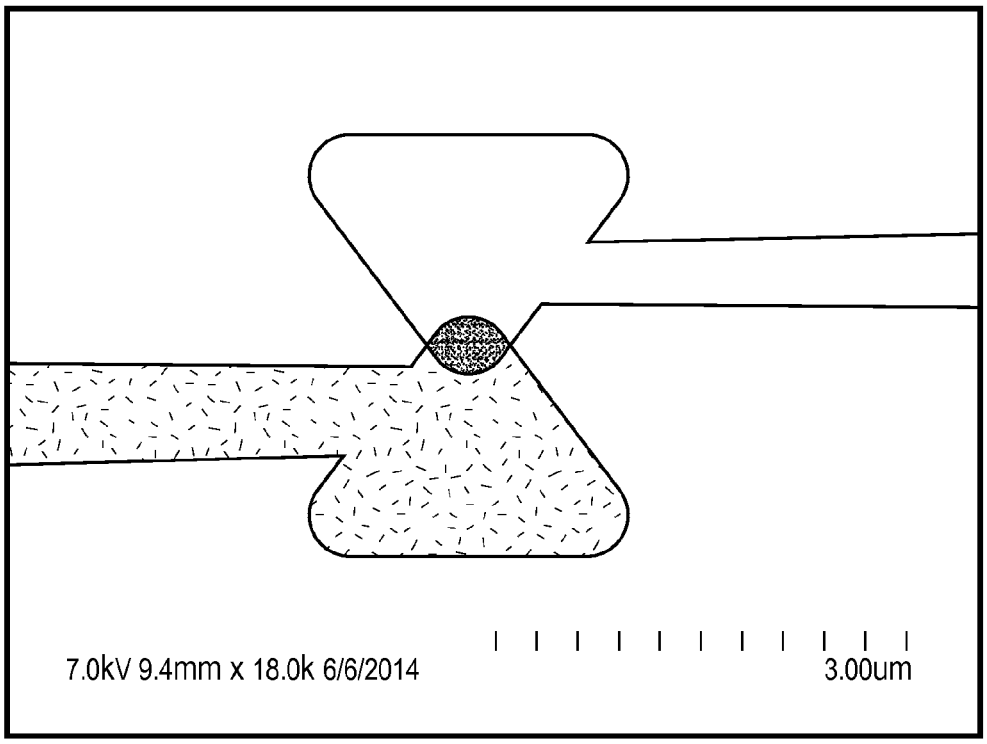
FIG. 7 is a photograph of a single bowtie antenna-coupled MIM.

FIG. 7 is a photograph of a single bowtie antenna-coupled MIM fabricated as described above.

Figure 8:
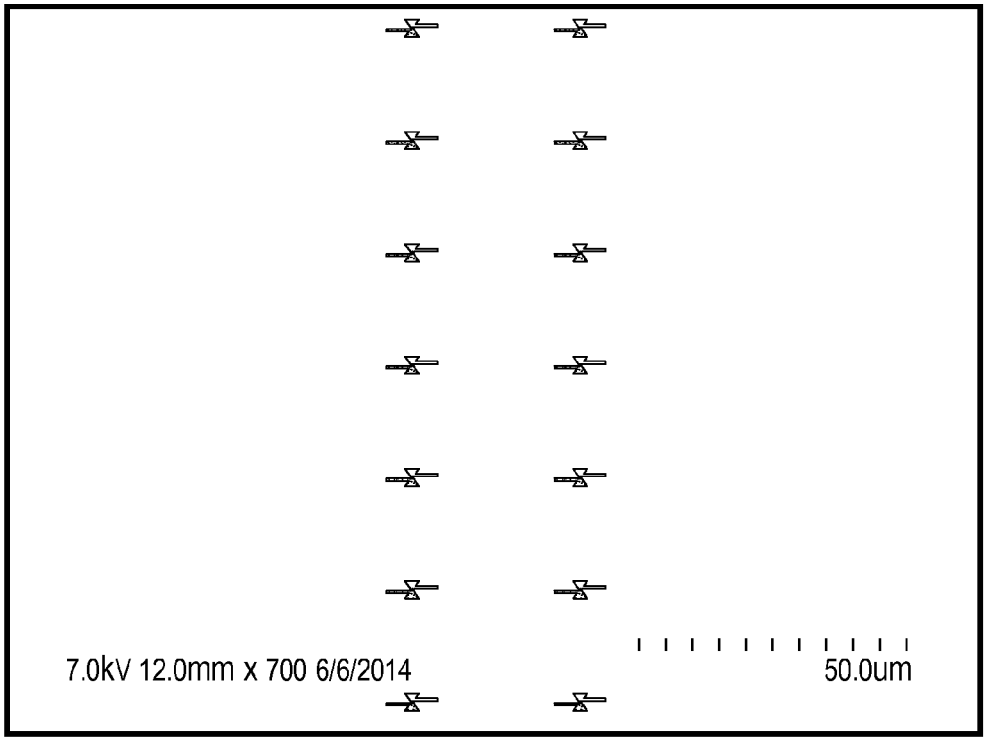
FIG. 8 is a photograph of an antenna-coupled MIM array.

FIG. 8 is a photograph of a 2×7 bowtie antenna-coupled MIM array fabricated as described above.

What is claimed is:

1. A native nickel oxide process comprising:

depositing a first metal layer on a substrate;

depositing an Ni layer on the first metal layer;

patterning the Ni layer and first metal layer to define a first triangular bowtie radiating element having a base and an apex;

subsequently oxidizing the Ni layer with reactive ion etching the Ni layer in an oxygen plasma to produce an oxidized Ni layer; and depositing a top layer of a second metal different from the first metal, to form a second radiating element of a bowtie antenna on the oxidized Ni layer, the top layer only partially overlapping the oxidized Ni layer near the apex of the triangular shaped radiating element.

2. The process of claim 1 wherein the first metal is aluminum (Al) and the second metal is platinum (Pt).

3. The process of claim 1 further comprising:

patterning the top layer to further define the second radiating element of the bowtie antenna, as a triangular radiating element having an apex overlapping the apex of the first triangular radiating element.

4. The process of claim 3 further wherein the step of patterning the Ni and first metal layers also forms a first arm adjacent the first triangular radiating element, and additionally comprising:

etching a portion of the oxidized Ni layer adjacent the arm; and depositing a first conductive pad adjacent the first arm.

5. The process of claim 1 wherein the deposited Ni layer is between 5 and 20 nanometers (nm) in thickness.

6. The process of claim 4 wherein the step of depositing a top layer also forms a second arm adjacent the second radiating element, and further comprising:

depositing a second conduction pad adjacent the second arm.

* * * * *